US012281434B2

(12) United States Patent
Shukri

(10) Patent No.: US 12,281,434 B2
(45) Date of Patent: Apr. 22, 2025

(54) LUGGAGE SYSTEMS WITH INTEGRAL GARMENT STEAMER

(71) Applicant: Mustafa Thair Shukri, West Caldwell, NJ (US)

(72) Inventor: Mustafa Thair Shukri, West Caldwell, NJ (US)

( * ) Notice: Subject to any disclaimer, the term of this patent is extended or adjusted under 35 U.S.C. 154(b) by 121 days.

(21) Appl. No.: 17/828,383

(22) Filed: May 31, 2022

(65) Prior Publication Data

US 2023/0407551 A1 Dec. 21, 2023

(51) Int. Cl.

| | |
|---|---|
| ***D06F 73/00*** | (2006.01) |
| ***A45C 13/22*** | (2006.01) |
| ***A45C 13/26*** | (2006.01) |
| ***A45C 13/28*** | (2006.01) |
| ***A45C 15/00*** | (2006.01) |

(52) U.S. Cl.

CPC ..... *D06F 73/00* (2013.01); *A45C 13/22* (2013.01); *A45C 13/26* (2013.01); *A45C 13/28* (2013.01); *A45C 15/00* (2013.01); *A45C 2200/00* (2013.01)

(58) Field of Classification Search

CPC ..... D06F 73/00; A45C 13/22; A45C 13/26; A45C 13/28; A45C 15/00; A45C 2200/00

See application file for complete search history.

(56) References Cited

U.S. PATENT DOCUMENTS

| | | | | |
|---|---|---|---|---|
| 2,413,830 A * | 1/1947 | Janosz | ..... | A45C 13/28 190/102 |
| 2,763,075 A * | 9/1956 | Vance | ..... | D06F 75/14 38/77.4 |
| 4,688,340 A * | 8/1987 | Ostrelich | ..... | D06F 75/34 74/553 |
| 6,857,209 B2 * | 2/2005 | Wehrwein | ..... | D06F 75/22 38/77.1 |

(Continued)

FOREIGN PATENT DOCUMENTS

| | | |
|---|---|---|
| CN | 202890815 U | 4/2013 |
| CN | 204070921 U | 1/2015 |
| IT | 20130051 A1 | 6/2015 |

OTHER PUBLICATIONS

Partial European Search Report dated Oct. 20, 2023, issued by the European Patent Office in connection with European Patent Application No. 23176353.3 (13 pages).

(Continued)

*Primary Examiner* — Tri M Mai

(74) *Attorney, Agent, or Firm* — McCarter & English, LLP

(57) ABSTRACT

A luggage system includes a luggage body forming an enclosure for transporting one or more garments and a steamer module secured to the luggage body. The steamer module is configured to receive water, generate steam from the received water, and discharge the steam. The steamer module can include a housing, a water reservoir, a steam production unit, a hose, and a power supply. The hose can be (Continued)

coupled between the steam production unit and a handle of a retractable handle assembly affixed to the luggage body, and configured to transfer steam generated by the steam production unit to the handle for discharge through perforations thereof. At least a portion of the hose can extend through at least a portion of a telescopic arm of the handle assembly to which the handle is releasably secured.

18 Claims, 9 Drawing Sheets

(56) References Cited

U.S. PATENT DOCUMENTS

| | | | | |
|---|---|---|---|---|
| 7,121,024 | B1 * | 10/2006 | Clevenberg | D06F 71/32 38/25 |
| 8,141,268 | B2 * | 3/2012 | Vezina | D06F 59/02 211/38 |
| 8,141,279 | B2 * | 3/2012 | Jiang | D06F 75/10 38/103 |
| 11,021,836 | B2 * | 6/2021 | Shin | D06F 58/20 |
| 2004/0010950 | A1 | 1/2004 | Leung et al. | |

OTHER PUBLICATIONS

Extended European Search Report dated Jan. 23, 2024, issued by the European Patent Office in connection with European Patent Application No. 23176353.3 (12 pages).

* cited by examiner

LUGGAGE SYSTEMS WITH INTEGRAL GARMENT STEAMER

TECHNICAL FIELD

The present invention relates generally to luggage and more particularly to luggage systems with an integral garment steamer.

BACKGROUND

Luggage, such as wheeled or rolling suitcases, carry-on bags, and other similar luggage systems, are widely used by travelers in airports, railroad stations, and other ports of travel. In order to facilitate efficient use of limited space, many pieces of luggage include one more compartments configured to receive, separate, organize, and secure a traveler's garments.

Many pieces of luggage include compartments that are configured to receive garments that have already been folded. Once placed in the luggage, the folded garments can be secured within the compartments using zippered flaps, straps, mesh, or other systems. Other pieces of luggage, or luggage compartments, are configured to receive garments on hangers, for example, suits, ironed shirts and blouses, and the like in an attempt to minimize wrinkling. Such compartments can also be provided with zippered flaps, straps, mesh, or other systems, which are also intended to minimize the amount that the garments become wrinkled during transit.

Despite the foregoing, currently available luggage does not entirely prevent wrinkling of clothing during transport. Accordingly, many travelers arrive at their destination with garments having some amount of wrinkling that must be addressed prior to wearing. As such, some travelers pack separate irons or garment steamers in their luggage, which they can use at their destination to remove the wrinkles from their garments. However, irons and garment steamers take up valuable and limited luggage space. Alternatively, some travelers choose to locate an iron or garment steamer at their destination. However, many travelers arrive at their destination and discover that an iron or garment steamer is not readily available.

Accordingly, there is a need for improved luggage that resolve these, as well as other, shortcomings of currently available luggage.

SUMMARY OF THE DISCLOSURE

In accordance with embodiments of the present disclosure, a luggage system includes a luggage body and a steamer module secured to the luggage body. The luggage body forms an enclosure for transporting one or more garments. The steamer module is configured to receive water, generate steam from the received water, and discharge the steam.

In accordance with another aspect of the present disclosure, a luggage system includes a luggage body, a retractable handle assembly affixed to the luggage body, and a steamer module. The luggage body forms an enclosure for transporting one or more garments. The handle assembly includes one or more telescopic arms and a handle having one or more perforations. The handle can be releasably secured to at least one of the one or more telescopic arms such that it is releasable from the one or more telescopic arms, extendable therefrom, and positionable to direct steam exiting the one or more perforations towards a garment. The steamer module includes a housing, a water reservoir, a steam production unit, a hose, and a power supply. The hose is coupled between the steam production unit and the handle, and configured to transfer steam generated by the steam production unit to the handle for discharge through the one or more perforations. At least a portion of the hose extends within at least a portion of the one or more telescopic arms.

In accordance with another aspect of the present disclosure, a steamer module for luggage includes a housing, a water reservoir configured to store water, a steam production unit configured to receive water from the water reservoir, a steamer head including one or more perforations for discharging steam, a hose having a first end and a second end, and a power supply. The water reservoir, the steam production unit, and the power supply are housed within the housing, which is configured to be affixed to a body of the luggage. The first end of the hose is coupled to the steam production unit and the second end of the hose is coupled to the steamer head such that the hose transfers steam generated by the steam production unit to the steamer head for discharge through the one or more perforations of the steamer head. The steamer head is positionable to direct steam exiting therefrom towards a garment.

Other objects and features will become apparent from the following detail description considered in conjunction with the accompanying drawings. It is to be understood, however, that the drawings are designed as an illustration only and not as a definition of the limits of the invention.

BRIEF DESCRIPTION OF THE DRAWINGS

The foregoing features of the present disclosure will be apparent from the following Detailed Description of the Invention, taken in connection with the accompanying drawings, in which.

DETAILED DESCRIPTION

The present disclosure relates to luggage systems having an integral garment steamer, as described in detail below in connection with FIGS. 1-5.

Figure 1A:
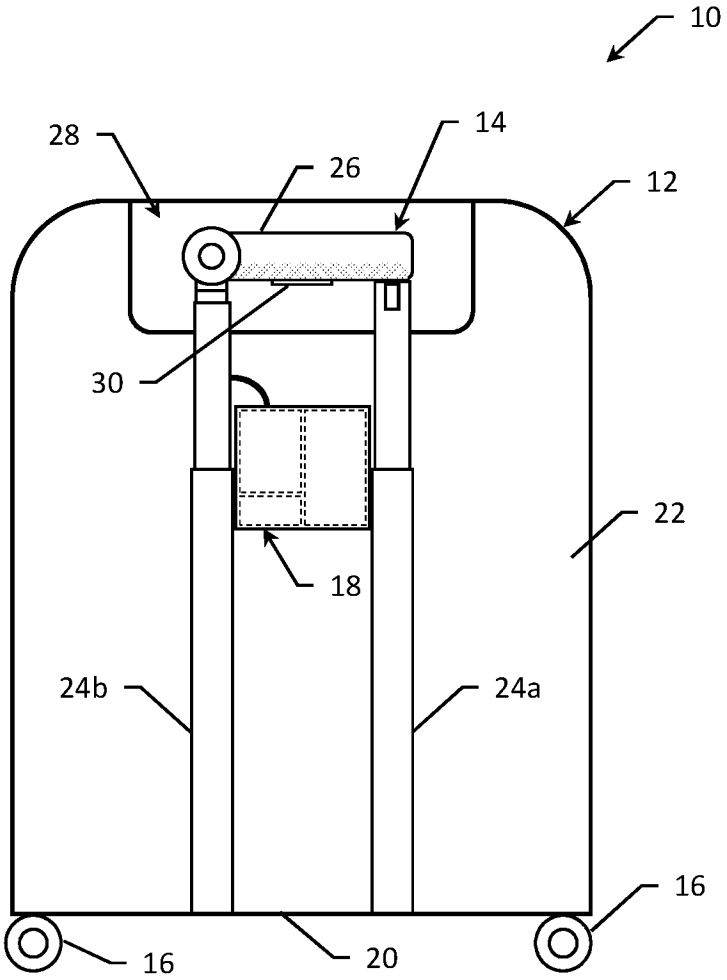
FIG. 1A is a rear elevational view of a luggage system according to the present disclosure with a retractable handle assembly positioned in a first configuration.
Figure 1B:
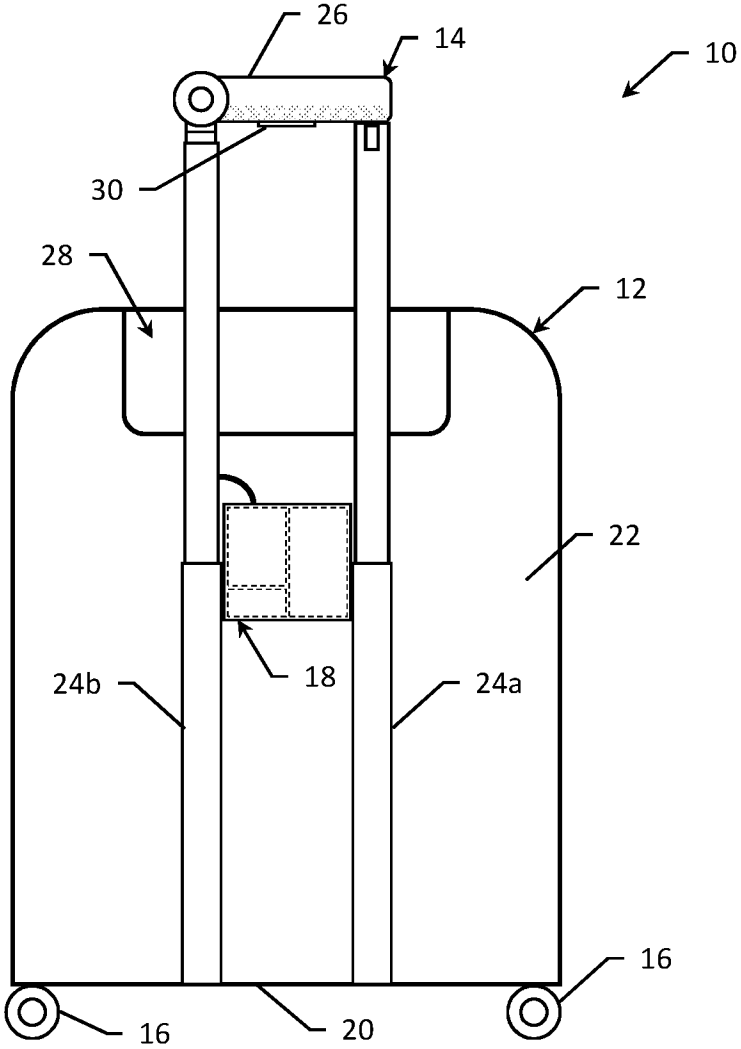
FIG. 1B is a rear elevational view of the luggage system of FIG. 1A with the retractable handle assembly positioned in a second configuration.

FIGS. 1A and 1B illustrate a luggage system 10 (hereinafter, "system 10") of the present disclosure. Specifically, FIG. 1A is a rear elevational view of the system 10 showing a retractable handle assembly 14 positioned in retracted configuration and FIG. 1B is a rear elevational view of the system 10 showing the handle assembly 14 positioned in an extended configuration. FIGS. 1A and 1B are referred to jointly herein.

As shown in FIGS. 1A and 1B, the system 10 includes a luggage body 12, the retractable handle assembly 14, one or more wheels 16, and a steamer module 18. The luggage body 12 defines an interior space for storing one or more garments or other items, and the one or more wheels 16 are provided on a bottom panel 20 of the luggage body 12 for transport of the system 10. The retractable handle assembly 14 can be affixed to a rear panel 22 of the luggage body 12. According to the embodiment shown in FIGS. 1A and 1B, the handle assembly 14 can be affixed to an exterior of the rear panel 22; however, it should be understood that the handle assembly 14 could alternatively be affixed to an interior side of the rear panel 22 (e.g., within the luggage body 12). As will be understood by those of skill in the art, the wheels 16 and the handle assembly 14 cooperate to facilitate ease of locomotion by permitting a user to pull or push the system 10 as he or she travels to their destination.

The handle assembly 14 includes a pair of generally parallel telescopic tubular arms 24*a* and 24*b* (together, telescopic arms 24) with a handle 26 connecting distal ends of the telescopic arms 24. The telescopic arms 24 can be retracted, or collapsed, and the handle 26 can be positioned within a recess 28 of the luggage body 12 (see, e.g., FIG. 1A) when the handle 26 is not needed, and the handle 26 can be readily withdrawn from the recess 28 into an extended position (see, e.g., FIG. 1B) when needed. The handle 26 can function and operate as a steamer head, which is discussed in greater detail in connection with FIGS. 2-4.

According to embodiments of the present disclosure, the handle assembly 14 can be moved from the retracted position to the extended position, or to an intermediate position, by depressing a button 30, or other latching mechanism, which allows the telescopic arms 24 to be freely extended or retracted. Similarly, the telescopic arms 24 and the handle 26 can be locked in the retracted position, the extended position, or an intermediate position, by releasing the button 30.

It should also be understood that the present disclosure contemplates additional configurations of the handle assembly 14 and variations from the disclosed configurations should not be considered to depart from the spirit and scope thereof. For example, according to some embodiments of the present disclosure, the handle assembly 14 could include a single telescopic tubular arm 24 with the handle 26 positioned at a distal end thereof.

Figure 2:
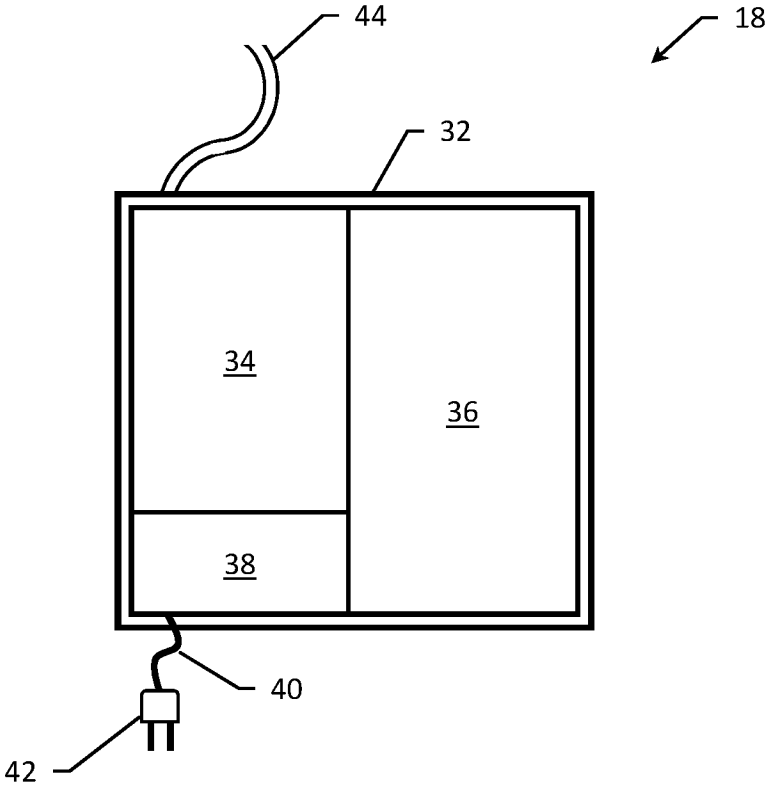
FIG. 2 is a diagram illustrating components of a steamer module of the luggage system of FIGS. 1A and 1B.

FIG. 2 is a block diagram illustrating internal components of the steamer module 18 of the system 10 of the present disclosure. The steamer module 18 includes a housing 32 enclosing a water reservoir 34, a steam production unit 36, and a power supply 38. As shown in FIGS. 1A and 1B, the steamer module 18 can be secured between the telescopic arms 24 on the exterior side of the rear panel 22, which not only provides easy access, but also utilizes space that may otherwise be unused, e.g., the steamer module 18 can be positioned in the dead space between the telescopic arms 24. Alternatively, the steamer module 18 could be positioned on the interior side of the rear panel 22 within the luggage body 12.

The water reservoir 34 is in fluidic communication with the steam production module 36, which heats water from the reservoir 34 in order to produce steam. As will be understood by those of ordinary skill in the art, the steam production module 36 can include a plurality of components for heating the water from the reservoir 34 and producing steam, such as, for example, a heating element (e.g., an electrical heating element), a pump for transferring the water, etc.

The power supply 38 is electrically coupled to the steam production unit 36 in order to provide electrical power thereto. The power supply 38 could be configured for use with 120 V, 220 V, or other mains voltages such that it is compatible for international use. As shown in FIG. 2, the power supply 38 can include a power cable 40 terminating at a plug 42 for receiving electrical power from a wall outlet or the like. According to some embodiments of the present disclosure, the power cable 40 could be configured to be manually or automatically retracted within the housing 32 for storage and transportation when the steam production unit is not in use. According to some embodiments of the present disclosure, the housing 32 could be a fire-rated enclosure, for example, a two-hour fire-rated enclosure. According to further embodiments of the present disclosure, the power supply 38 could include a battery unit for providing power to the steam production unit 36. The battery unit could include one or more disposable or rechargeable cells (e.g., lithium, polymer, nickel metal hydride, etc.) and could be removable from the steamer module 18, for example, so as to comply with FAA regulations in situations where the luggage system 10 is being "checked" during a flight. As discussed in greater detail below, a hose 44 extends from the steam production unit 36 to the handle 26, which is configured to disperse the steam generated thereby.

FIGS. 3A-3D illustrate positions of the handle assembly 14 of the system 10 as it is converted for use from a normal position, where the handle 26 is fixed to the telescopic arms 24 for storage and transportation, to a deployed position, where the handle 26 is detached from the telescopic arms 24 for steam production.

Figure 3A:
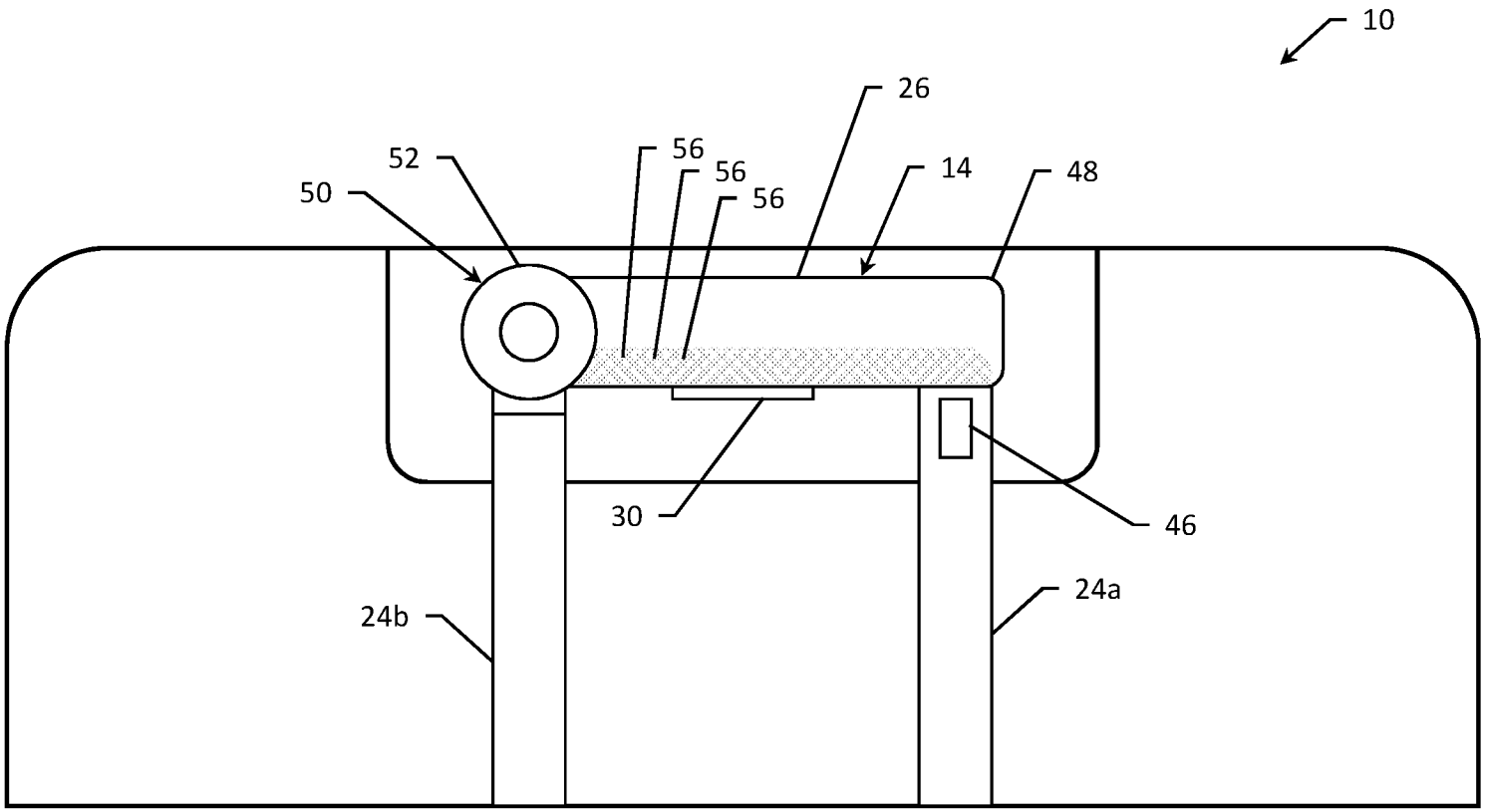
FIG. 3A is a partial rear elevational view of the retractable handle assembly of the luggage system of FIGS. 1A and 1B showing a handle thereof in a first position.

FIG. 3A is a rear elevational view of the handle assembly 14 with the handle 26 shown in a first position, e.g., the normal position. As shown, the handle assembly 14 can include a release clip 46, which is configured to secure a distal end 48 of the handle 26 to the telescopic arm 24*a* during storage and transportation of the system 10. The handle 26 includes a proximal end 50 opposite the distal end 48. The proximal end 50 of the handle 26 includes a swivel member 52 that secures the handle 26 to the telescopic arm 24*b*. As will be discussed in greater detail herein below, the swivel member 52 can be configured to provide for radial rotation between the handle 26 and the telescopic arm 24*b* in the direction of arrow A shown in FIG. 3B, as well as axial rotation between the handle 26 and the telescopic arm 24*b* in the direction of arrow B shown in FIG. 3C.

Figure 3B:
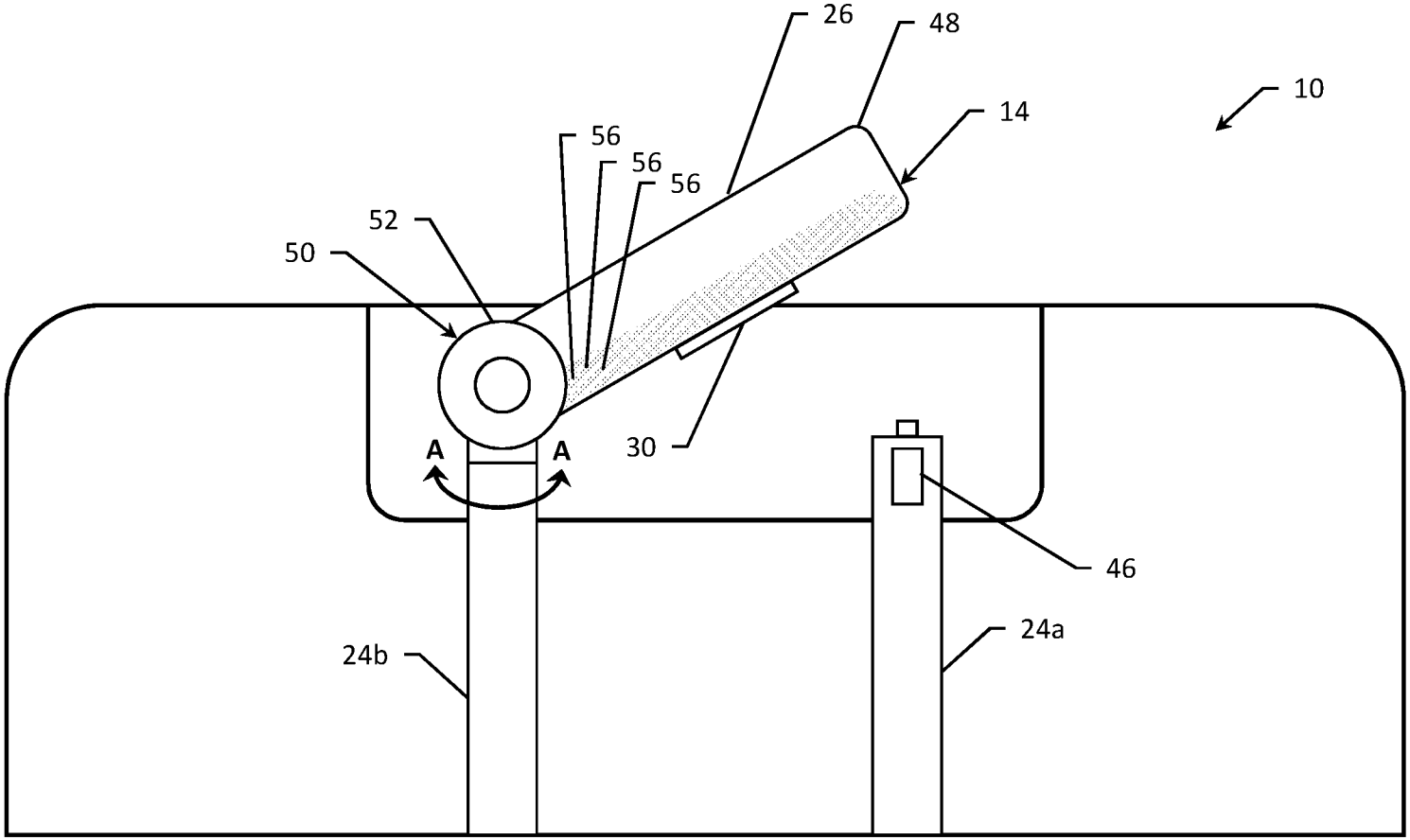
FIG. 3B is a partial rear elevational view of the retractable handle assembly of FIG. 3A showing the handle in a second position.
Figure 3C:
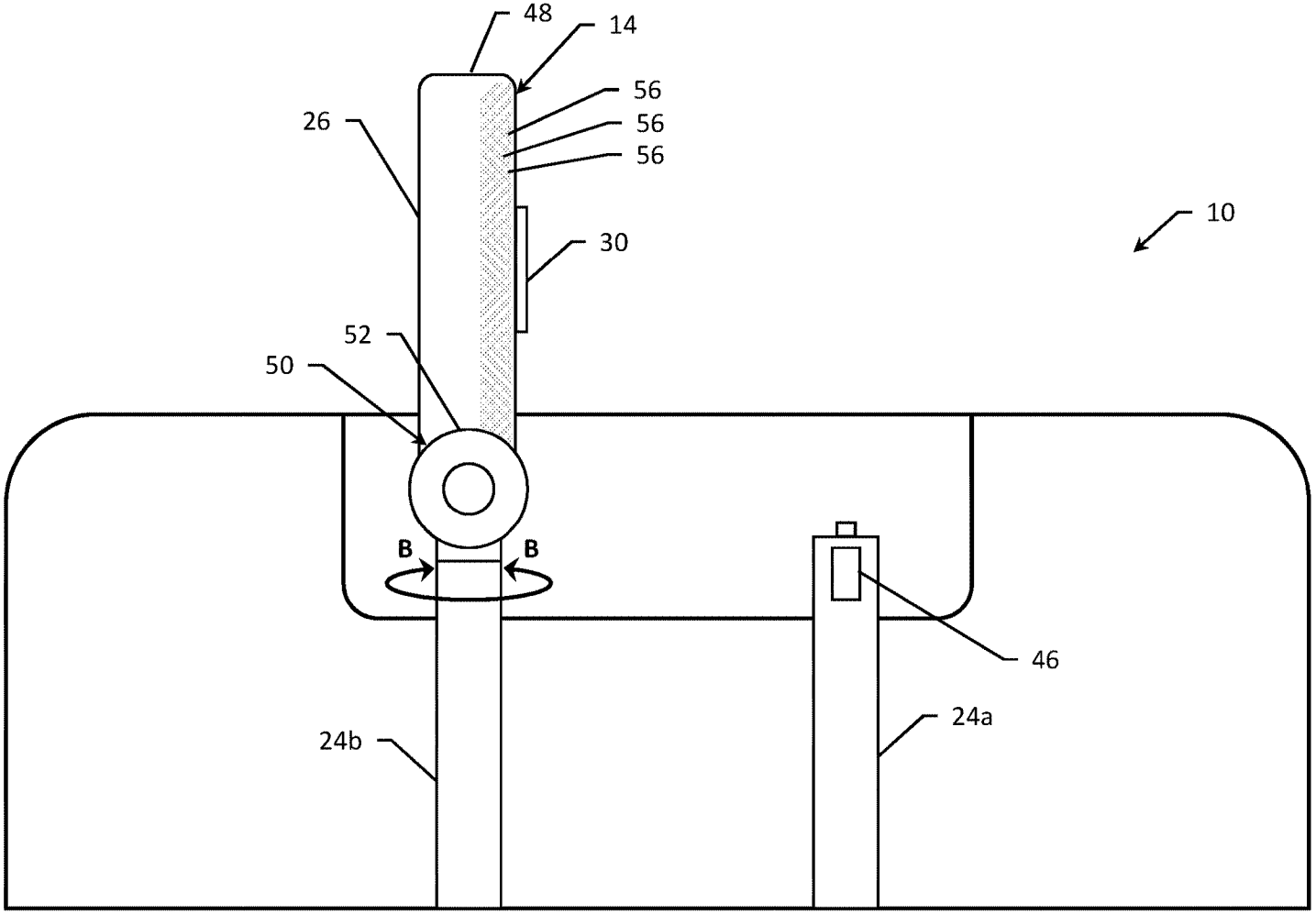
FIG. 3C is a partial rear elevational view of the retractable handle assembly of FIG. 3A showing the handle in a third position.

FIG. 3B is a rear elevational view of the handle assembly 14 with the handle 26 shown in a second position, e.g., a first detached position, and FIG. 3C is a rear elevational view of the handle assembly 14 with the handle 26 shown in a third position, e.g., a second detached position. As shown in FIGS. 3B and 3C, the distal end 48 of the handle 26 can be disconnected from the telescopic arm 24 by depressing, or otherwise releasing, the clip 46, which secures the handle 26 to the telescopic arm 24*a*. When the clip 48 is released and the distal end 48 of the handle 26 is decoupled from the telescopic arm 24*a*, the handle 26 can be rotated in the direction of arrow A about the swivel member 52 until reaching the second detached position shown in FIG. 3C, where the handle 26 is substantially vertical and axially aligned with the telescopic arm 24*b*. It should be understood that the handle 26 can be releasably secured with the first telescopic arm 24*a* by means other than the clip 46, as is customarily known in the art. For example, this connection can involve a latch, a clasp, a magnetic connection, a depressible pin and recess, a spring-loaded connection, a press-fit connection, a threaded collar, a bayonet mount, etc.

Figure 3D:
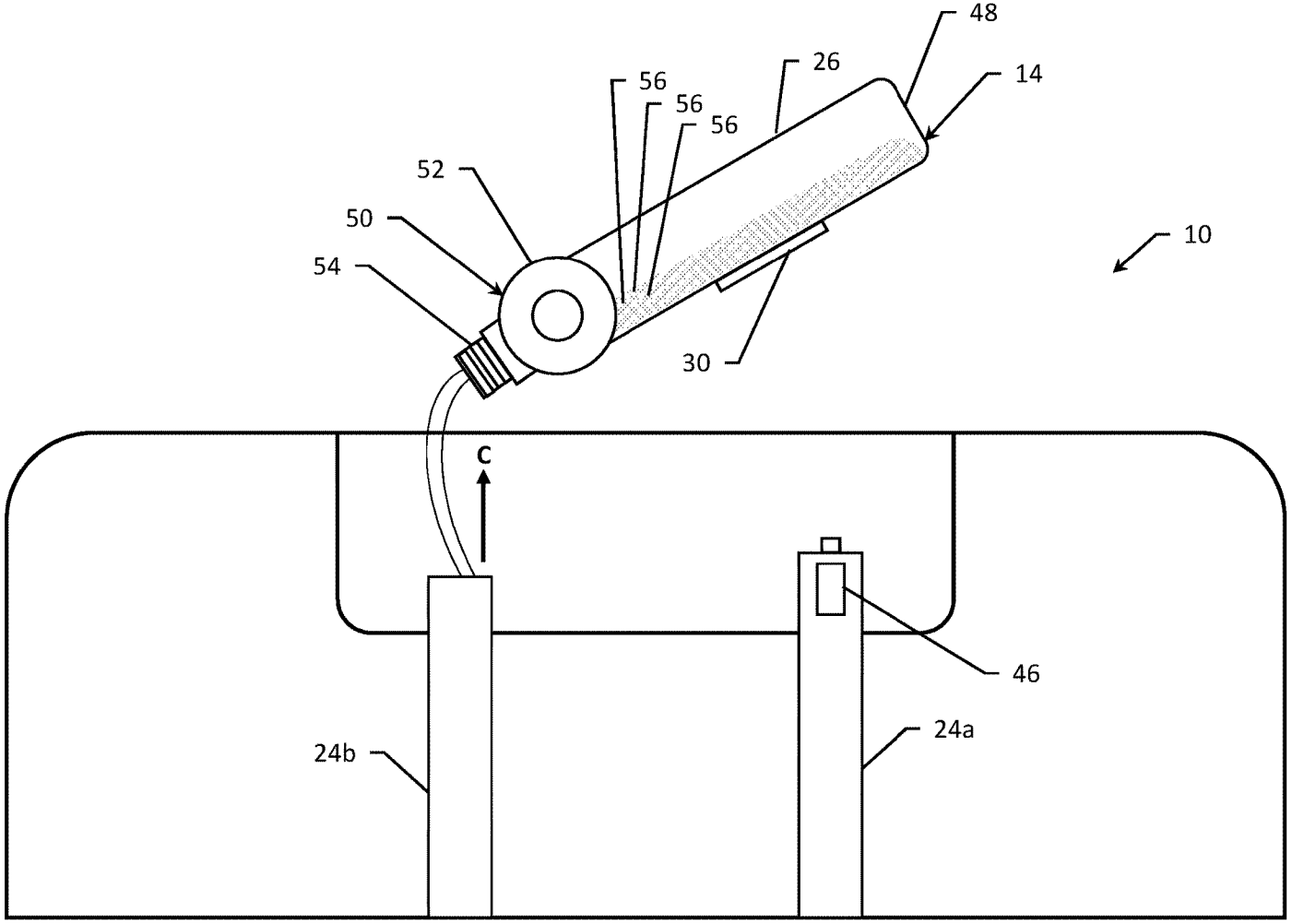
FIG. 3D is a partial rear elevational view of the retractable handle assembly of FIG. 3A showing the handle in a fourth position.

With the handle 26 substantially axially aligned with the telescopic arm 24*b*, the handle 26 can be axially rotated in the direction of arrow B (e.g., about a shared central axis of the handle 26 and the telescopic arm 24*b*) in order to decouple the handle 26 from the telescopic arm 24*b*. For example, as shown in FIG. 3D, the swivel member 52 can include a threaded portion 54, which engages a reciprocal threaded portion of the telescopic arm 24*b*. Those of ordinary skill in the art will understand that the embodiments described herein are merely exemplary, and one or more additional or alternative means for releasably securing the handle 26 to the telescopic arms 24 can be employed without departing from the spirit and scope of the present disclosure. For example, this connection can involve a latch, a clasp, a magnetic connection, a depressible pin and recess, a spring-loaded connection, a press-fit connection, a threaded collar, a bayonet mount, etc.

Figure 4:
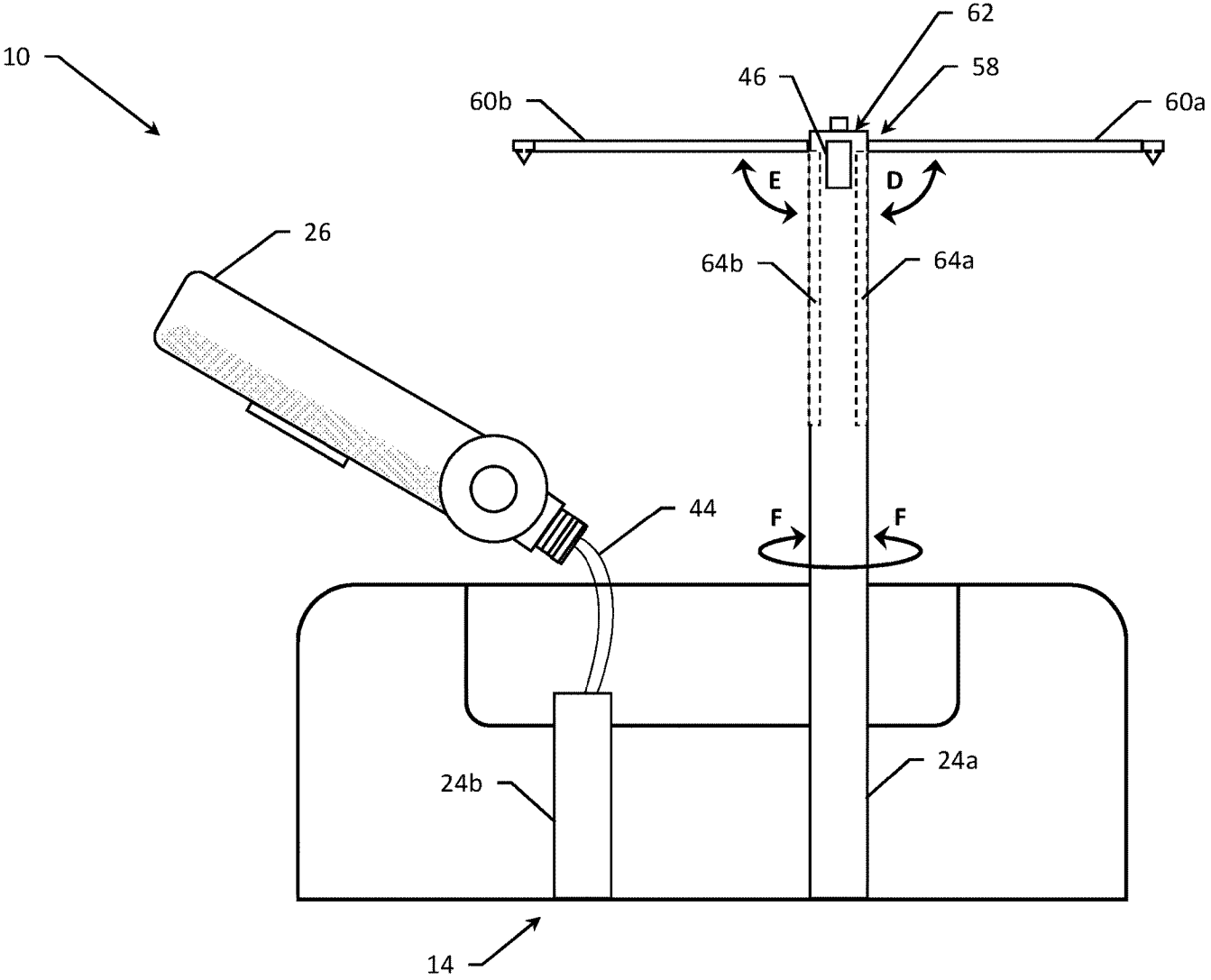
FIG. 4 is a rear elevational view of the luggage system of FIGS. 1A and 1B illustrating a retractable hanger assembly thereof.

With continued reference to FIG. 3D, when the handle 26 is decoupled from the telescopic arm 24*b*, the handle 26 can be moved in the direction of arrow C and extended away from the telescopic arm 24*b* and the body 12 of the system 10. As shown, the hose 44 can be positioned within the tubular telescopic arm 24*b* and extend from the steamer module 18 to the handle 26, thereby coupling the handle 26 to the steamer module 18 and carrying steam from the steamer module 18 to the handle 26. Moreover, positioning the hose 44 within the telescopic arm 24*b* protects the hose 44 from damage during transportation or storage of the system 10 when not in use. Alternatively, the hose 44 can be positioned in a pouch or container immediately adjacent the steamer module 18, or in the body 12. According to some embodiments of the present disclosure, the hose 44 can be selectively retractable, such that the hose 44 can be easily retracted within the telescopic arm 24*b* and/or body 12. For example, the system 10 could be configured such that pulling the handle 26 away from the telescopic arm 24*b* to a fully extended position (e.g., as shown in FIG. 4) locks, or otherwise secures, the hose 44 in a fully deployed position, and pulling the handle 26 a second time, where the hose 44 is already fully deployed, causes the hose 44 to retract within the telescopic arm 24*b* to the position shown in FIG. 3C.

As shown in FIG. 3D, the handle 26 is substantially hollow and includes a plurality of perforations 56, or nozzles, such that steam generated within the steam module 18 can pass through the hose 44, into the handle 26, and exit through the perforations 56. Accordingly, a user can grasp the handle 26, e.g., at the swivel member 52, and direct steam exiting the perforation 56 towards a garment, thereby removing wrinkles from the garment. The threaded portion 54 of the handle 26 can include an elongated section that can be held by a user.

According to some embodiments of the present disclosure, the button 30, discussed in connection with FIGS. 1A and 1B, can also be configured to actuate a stop valve, or the like, positioned between the hose 44 and the handle 26 in order to selectively control the flow of steam there between. Accordingly, by depressing the button 30 when the steamer module 18 is in use, a user can selectively control the amount of steam that exits the handle 26 through the perforations 56 and the duration of steam production.

Those of skill in the art will understand that the handle 26 can be returned to the position shown in FIG. 3A by reversing the foregoing steps. Specifically, the handle 26 can be returned to the position shown in FIG. 3A by retracting the hose 44 within the telescopic arm 24*b*, axially aligning the handle 26 with the telescopic arm 24*b*, rotating the handle 26 to engage the threaded portion 54 thereof with the telescopic arm 24*b*, and finally rotating the distal end 48 of the handle 26 towards the telescopic arm 24*a* until the handle 26 engages the clip 46, thereby securing the handle 26 in the normal position shown in FIG. 3A.

FIG. 4 is a partial rear elevational view of the luggage system 10 of the present disclosure illustrating an optional garment hanger assembly 58 thereof. The hanger assembly 58 includes hanger arms 60*a* and 60*b* (together, hanger arms 60), which extend from a distal end 62 of the first telescopic arm 24*a*. During use, the first telescopic arm 24*a* can be fully extended (e.g., as shown in FIG. 1B, for example) and the hanger arms 60 can be rotated to extend at substantially right angles with respect to the telescopic arm 24*a*, such that shirts, pants, or other garments can be hung on the hanger arms 60 and provided with steam exiting the perforations 56 of the handle 26. As such, the hanger arms 60 can be formed from a lightweight plastic, metal, or composite material to reduce the overall weight of the system 10. When not in use, the hanger arms 60 can be collapsed towards the telescopic arm 24*a* for transportation and storage by rotating the hanger arms 60*a* and 60*b* in the direction of arrows D and E, respectively. It should be understood that a greater or lesser number of hanger arms 60 could be provided without departing from the spirit and scope of the present disclosure.

According to some embodiments of the present disclosure, the telescopic arm 24*a* can be provided with first and second channels or recesses 64*a* and 64*b* (together, channels 64) for receiving the respective hanger arms 60*a* and 60*b*. According to further embodiments of the present disclosure, the clip 46, discussed in connection with FIGS. 3A-3D, could also be configured to selectively secure the hangers in place. For example, actuating the clip 46 could release the hanger arms 60 from the deployed position shown in FIG. 4 and allow the hanger arms to be moved to a retracted position where they are stored and locked within the channels 64. Likewise, depressing the clip 46 could release the hanger arms 60 from the locked position within the channels 64 and allow the hanger arms to be moved to the deployed position. According to still further embodiments of the present disclosure, the telescopic arm 24*a* could be rotatable about a central axis, for example, in the direction of arrow F, such that the user can position the hanger arms 60 in any desired rotational position.

Figure 5:
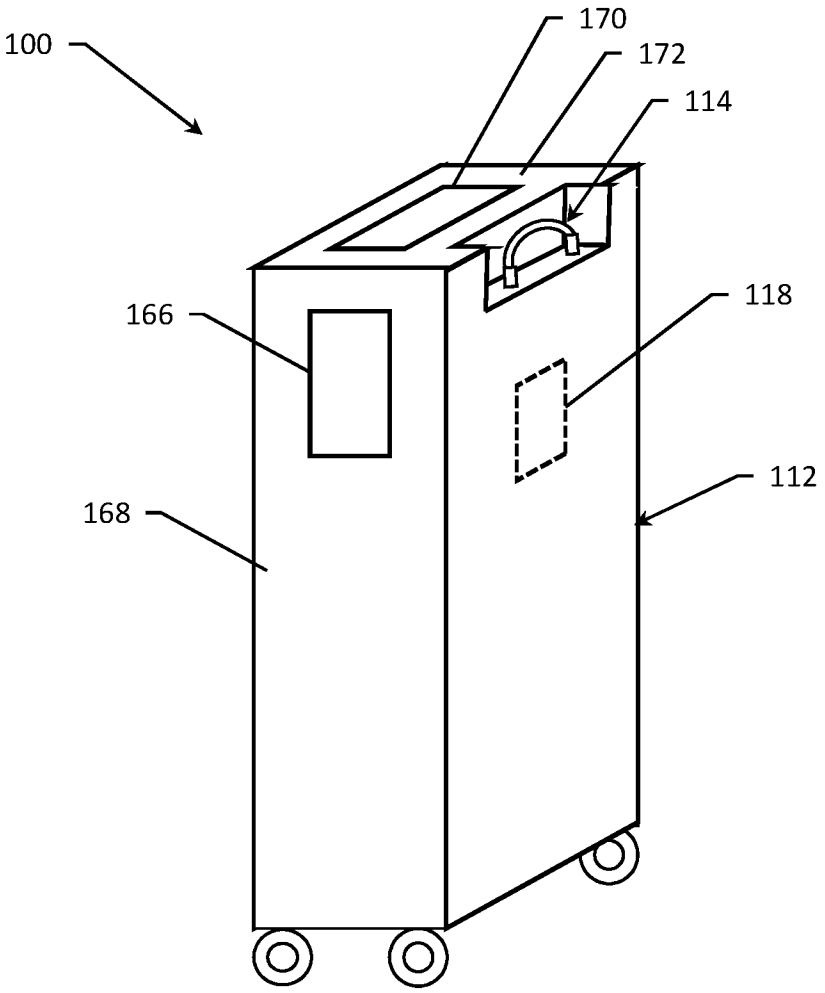
FIG. 5 is a perspective view of another luggage system according to the present disclosure.

FIG. 5 is a perspective view of another luggage system 100 according to the present disclosure. Luggage system 100 can be substantially similar in form and function to luggage system 10, except for the differences noted herein.

Accordingly, the system 100 includes a luggage body 112, a retractable handle assembly 114, one or more wheels 116, and a steamer module 118. As shown, the retractable handle assembly 114 and the steamer module 118 are positioned substantially within the luggage body 112, but are otherwise similar in form and function to the retractable handle assembly 14 and the steamer module 18 discussed in connection with FIGS. 1A and 1B. Notably, system 100 includes one or more exterior openings 166, 170 for accessing one or more components of the steamer module 118. For example, one or more of a first opening 166 on a side panel 168 of the body 112 or a second opening 170 on a top panel 172 of the body 112 could be provided for accessing a water reservoir or power supply (not shown) of the steamer module 118.

It should also be understood that in some embodiments the steamer module 118 is not integrated with the handle assembly 114, but instead could be an independent module secured to the luggage body 112. In this configuration, the system 100 would include a steamer head that is separate from the handle assembly 114, but nonetheless in similar form, and connected to the steamer module 118 by way of a hose, such as hose 44. The steamer head could be positioned within the luggage body 112 and removed therefrom through one of the openings 166, 170 for use.

Having thus described the system and methods in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. A luggage system, comprising:

a luggage body forming an enclosure for transporting one or more garments; and a steamer module secured to the luggage body, the steamer module including a steamer head configured to discharge steam, a water reservoir, a steam production unit, a power supply, and a hose coupled between the steam production unit and the steamer head, the hose configured to transfer steam generated by the steam production unit to the steamer head, the steamer module configured to receive water, generate steam from the received water, and discharge the steam, wherein the steamer head is a handle of a handle assembly affixed to the luggage body, the handle including a plurality of perforations configured to discharge the steam, and wherein the handle is rotatable about a swivel member.

2. The luggage system of claim 1, wherein the handle assembly includes one or more telescopic arms and the handle is secured to one of the one or more telescopic arms.

3. The luggage system of claim 2, wherein the one or more telescopic arms includes two telescopic arms and the handle is releasably secured to both of the two telescopic arms.

4. The luggage system of claim 2, wherein at least a portion of the hose extends within at least a portion of the telescopic arm to which the handle is secured.

5. The luggage system of claim 4, wherein the handle is releasable from the telescopic arm to which the handle is secured.

6. The luggage system of claim 5, comprising means for releasably securing the handle to the telescopic arm.

7. The luggage system of claim 2, wherein the one or more telescopic arms includes two telescopic arms, the handle is releasably secured to a first of the two telescopic arms, and a second of the two telescopic arms includes a retractable hanger.

8. A luggage system, comprising:

a luggage body forming an enclosure for transporting one or more garments;

a retractable handle assembly affixed to the luggage body, the handle assembly comprising one or more telescopic arms and a handle with one or more perforations, the handle releasably secured to at least one of the one or more telescopic arms; and a steamer module comprising a housing, a water reservoir, a steam production unit, a hose, and a power supply;

wherein the hose is coupled between the steam production unit and the handle, and configured to transfer steam generated by the steam production unit to the handle for discharge through the one or more perforations;

wherein at least a portion of the hose extends within at least a portion of the one or more telescopic arms;

wherein the handle is releasable from the one or more telescopic arms and extendable therefrom, such that the handle is positionable to direct steam exiting the one or more perforations towards a garment.

9. The luggage system of claim 8, wherein the one or more telescopic arms includes two telescopic arms and the handle is releasably secured to both of the two telescopic arms.

10. The luggage system of claim 8, comprising a means for releasably securing the handle to the telescopic arm.

11. The luggage system of claim 8, wherein the one or more telescopic arms includes two telescopic arms, the handle is releasably secured to a first of the two telescopic arms, and a second of the two telescopic arms includes a retractable hanger.

12. The luggage system of claim 8, wherein the handle is rotatable about a swivel member.

13. A luggage system, comprising:

a luggage body forming an enclosure for transporting one or more garments;

a steamer module secured to the luggage body, the steamer module including a steamer head configured to discharge the steam, a water reservoir, a steam production unit, a power supply, and a hose coupled between the steam production unit and the steamer head, the hose configured to transfer steam generated by the steam production unit to the steamer head, the steamer module configured to receive water, generate steam from the received water, and discharge the steam; and a handle assembly affixed to the luggage body, the handle assembly including one or more telescopic arms and a handle secured to one of the one or more telescopic arms, wherein the handle includes a plurality of perforations configured to discharge the steam and the steamer head is the handle of the handle assembly, and wherein at least a portion of the hose extends within at least a portion of the telescopic arm to which the handle is secured.

14. The luggage system of claim 13, wherein the one or more telescopic arms includes two telescopic arms and the handle is releasably secured to both of the two telescopic arms.

15. The luggage system of claim 13, wherein the handle is releasable from the telescopic arm to which the handle is secured.

16. The luggage system of claim 15, comprising means for releasably securing the handle to the telescopic arm.

17. The luggage system of claim 13, wherein the one or more telescopic arms includes two telescopic arms, the handle is releasably secured to a first of the two telescopic arms, and a second of the two telescopic arms includes a retractable hanger.

18. The luggage system of claim 13, wherein the handle is rotatable about a swivel member.

* * * * *